US005884758A

United States Patent [19]

Sigouin et al.

[11] Patent Number: 5,884,758

[45] Date of Patent: Mar. 23, 1999

[54] LIQUID POUCH WITH INTERNAL STRAW RESTRAINING PASSAGE

[76] Inventors: Claire C. Sigouin, 421 rue Nobert suite 400, Longueuil Quebec, Canada, J4J 4Y1; Guy J. Houle, 1321 rue Sherbrooke Ouest suite A-31, Montreal Quebec, Canada, H3G 1J4

[21] Appl. No.: 791,844

[22] Filed: Jan. 30, 1997

[51] Int. Cl.[6] ..... B65D 83/14

[52] U.S. Cl. ..... 206/217; 229/103.1; 383/200; 426/85

[58] Field of Search ..... 206/217, 218; 229/103.1; 383/40, 200; 426/85

[56] References Cited

U.S. PATENT DOCUMENTS

| | | | |
|---|---|---|---|
| 2,849,321 | 8/1958 | Lhermitte et al. | 229/103.1 |
| 2,992,118 | 7/1961 | Daline | 229/103.1 |
| 3,074,612 | 1/1963 | Schneider | 229/103.1 |
| 3,144,976 | 8/1964 | Freshour | 229/103.1 |
| 3,730,336 | 5/1973 | Feldman . | |
| 3,791,570 | 2/1974 | Hopkins | 229/103.1 |
| 3,799,914 | 3/1974 | Schmit et al. | 229/103.1 |
| 4,806,021 | 2/1989 | Koudstaal et al. | 229/103.1 |
| 4,858,766 | 8/1989 | Tsai | 229/103.1 |
| 5,201,460 | 4/1993 | Caines | 229/103.1 |
| 5,261,532 | 11/1993 | Fauci | 206/218 |
| 5,564,621 | 10/1996 | Writt | 229/103.1 |

*Primary Examiner*—Jim Foster
*Attorney, Agent, or Firm*—Guy J. Houle

[57] ABSTRACT

A plastic film liquid pouch is formed from impermeable film sheet material and has opposed side walls with sealed circumferencial edges to form an enclosed chamber. A liquid product is provided in the chamber and a space is also provided to permit expansion of the liquid. An internal straw restraining passage is formed by seals between the opposed side walls. The straw restraining passage communicates with the liquid chamber and a straw is held loosely captive inside the passage and axially displaceable therein. The straw restraining passage defines a reduced cross-sectional area of the chamber whereby the opposed side walls of the bag at the restraining passage may be collapsed towards one another by the fingers of a user person thereby displacing a restricted quantity of liquid to expose the straw to grasp the straw and push an end of the straw through the film sheet material whereby to extract the liquid from the pouch either by sipping it through the straw or by compressing the pouch to force the liquid through the straw.

6 Claims, 6 Drawing Sheets

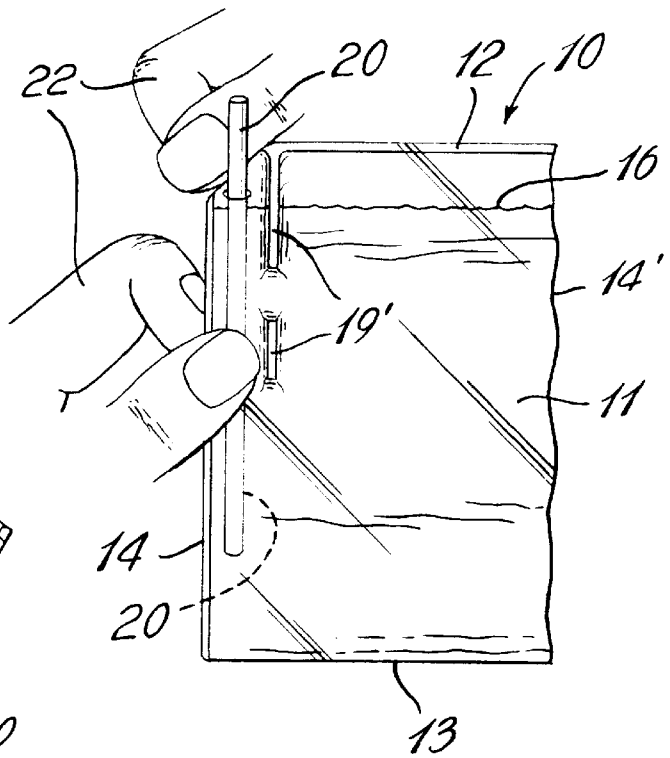
Fig. 7
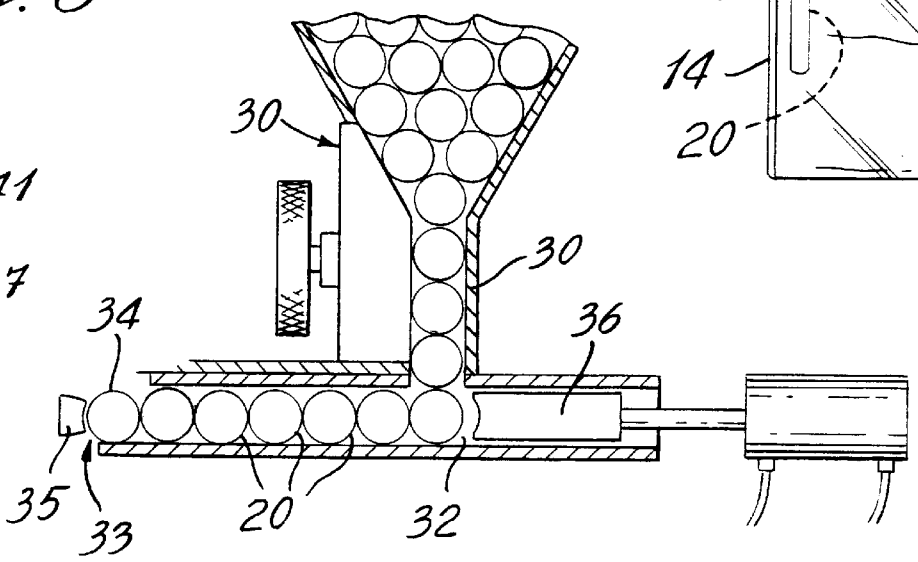
Fig. 8
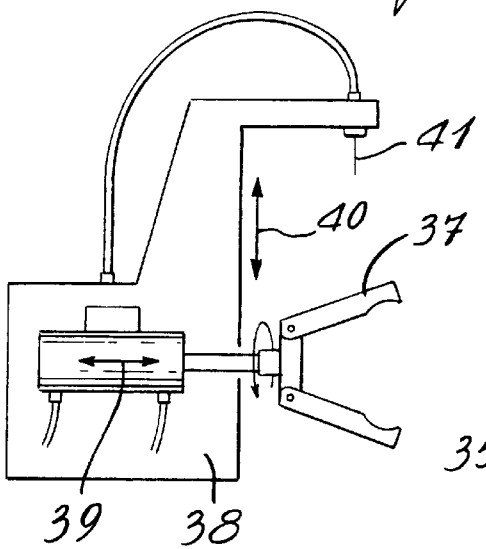

LIQUID POUCH WITH INTERNAL STRAW RESTRAINING PASSAGE

TECHNICAL FIELD

The present invention relates to a liquid pouch having a straw held captive in a restraining passage therein, which passage permits the straw to be easily located, grasped and pushed through the pouch wall whereby to extract liquid from the pouch.

BACKGROUND ART

It is known to provide a package liquid container, such as a flexible plastic bag containing a liquid as well as a straw freely floating therein whereby liquid from the bag may be extracted by manipulating the bag to grasp the free-floating straw and push it through the bag so that liquid can be sipped through the straw or be expulsed from the bag through the straw by compressing the bag. Such a package liquid container is described in U.S. Pat. No. 3,730,336 issued on May 1, 1973. However, there are disadvantages associated with such bags and one of these disadvantages is that it is difficult to locate and grasp the free-floating straw by compressing the side walls of the bags due to the liquid and air which is contained in the bags. In an attempt to alleviate this problem a large air space is left within the bag so that the side walls can be collapsed with the liquid having sufficient space to be displaced inside the bag. When manipulating the bag to locate the straw often, weak seams of the bag can give away and the liquid accidentally discharge through the seam making it very messy. Also because, a large quantity of air needs to be provided it is necessary to make the pouch much larger than the contained volume of liquid.

Another disadvantage of such flexible liquid containers is that in trying to grasp the free floating straw within the liquid, often the straw will be bent in the process of while trying to grasp it through the liquid and thereby weakening the rigidity of the straw making it ineffective to puncture the bag. It is also necessary with such flexible liquid containers to manufacture the container with clear plastic material whereby the straw can be visually located by the user person. Therefore, the printing material appearing on the bag must be restricted whereby to provide this visual access to the interior of the pouch. It is necessary with such pouches or bags that a major portion thereof remain transparent.

SUMMARY OF INVENTION

It is a feature of the present invention to provide a plastic film liquid pouch which overcome the above mentioned disadvantages of prior art flexible liquid pouches. It is a further feature of the present invention to provide a plastic film liquid pouch which contains an inner straw restraining passage which communicates with the liquid chamber of the pouch and which retains a straw captive internally of the package to permit easy location, grasping, and puncturing of the bag by the use of the straw. Another feature of the present invention is to provide a plastic film liquid pouch having an internal straw restraining passage communicating with a liquid chamber of the pouch and which is operative even if the liquid pouch is totally formed of an opaque film material.

Another feature of the present invention is to provide a plastic film liquid pouch which necessitates a reduced air space within the chamber thereby permitting greater volumes of liquids to be contained within such pouches.

Another feature of the present invention is to provide a novel method of forming a plastic film liquid pouch with a straw therein held captive restrained in a straw restraining passage internally of the pouch.

According to the above features, from a broad aspect, the present invention provides a plastic film liquid pouch comprising a pair of opposed side walls formed from impermeable film sheet material and having a sealed top edge, a sealed bottom edge, and opposed sealed side edges to form an enclosed chamber. A liquid product is provided in the chamber. A space is provided within the chamber to permit expansion of the liquid product. An internal straw restraining passage is formed by seal means between the opposed side walls. The straw restraining passage communicates with the liquid chamber. A straw is held captive within the straw restraining passage but axially displaceable therein. The straw restraining passage defines a reduced cross-sectional area of the chamber whereby the opposed side walls of the bag at the restraining passage maybe collapsed towards one another by the fingers of the user person while displacing a restricted quantity of liquid whereby to grasp the straw and push an end of the straw through the film sheet material to extract the liquid product from the pouch.

BRIEF DESCRIPTION OF DRAWINGS

A preferred embodiment of the present invention will now be described with reference to the accompanied drawings in which

FIG. 7 is a perspective view showing how the plastic film liquid pouch and straw is manipulated to puncture the bag with the straw whereby to extract the liquid product therefrom;

FIG. 8 is a simplified section view showing how straws are coalated and grasped for positioning within a plastic pouch:

DESCRIPTION OF PREFERRED EMBODIMENTS

Figure 1:
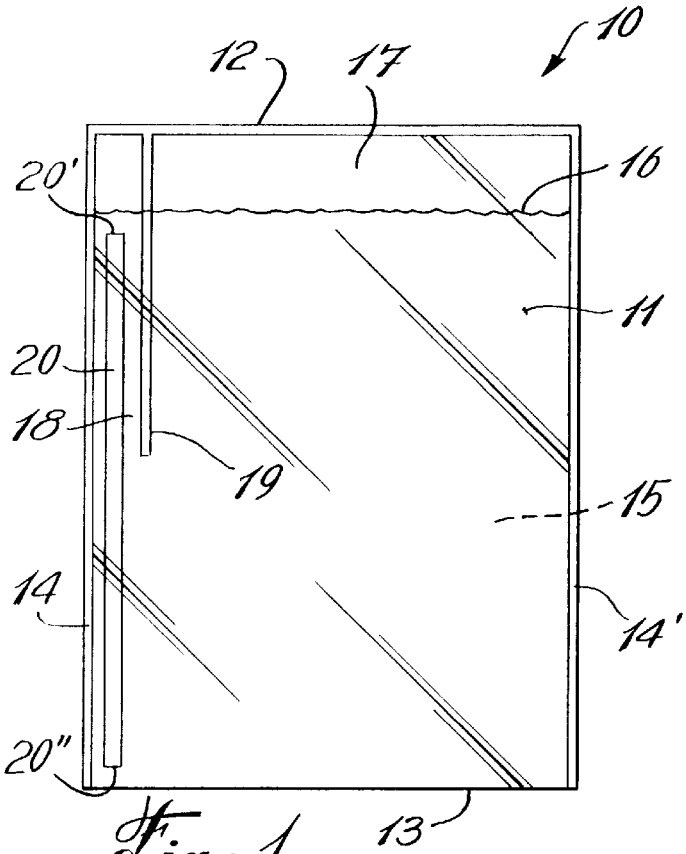
FIG. 1 is a plan view of the plastic film liquid pouch of the present invention.

Referring now to the drawings more particularly to FIG. 1 there shown generally at 10 the plastic film liquid pouch of the present invention. As here in shown the pouch is comprised of a pair of opposed side walls 11 and 11' formed from impermeable film sheet material and having a sealed top edge 12, a sealed bottom edge 13, and opposed sealed side edges 14 and 14' whereby to form an enclosed chamber 15A liquid product 16 is contained within the chamber 15 in a predetermined quantity and a space 17 is provided above the liquid product whereby to permit expansion thereof.

An internal straw restraining passage 18 is formed by seal means, herein a seal line 19 fusing both side walls 11 and 11' together and which extends from the top sealed edge 12 and spaced parallel to the sealed side edge 14 a predetermined distance whereby to restrain a straw 20 inside the bag. This internal straw restraining passage prevents the straw from free-floating within the closed chamber 15 but is loosely retained within the restraining passage to permit the straw to be grasped and move axially therein to permit puncturing of the bag, as will be described later.

Figure 4:
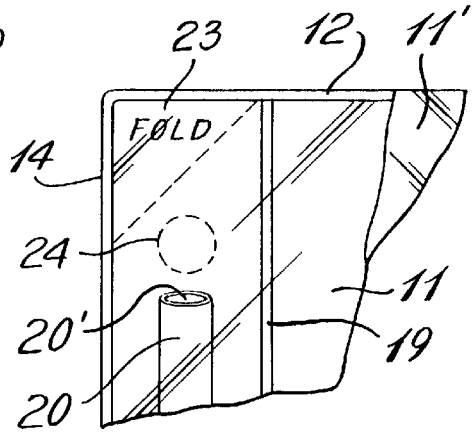
FIG. 4 is a fragmented plan view of the plastic film liquid pouch showing printed instructional information contained in a top corner of the pouch above the straw retraining passage.
Figure 5:
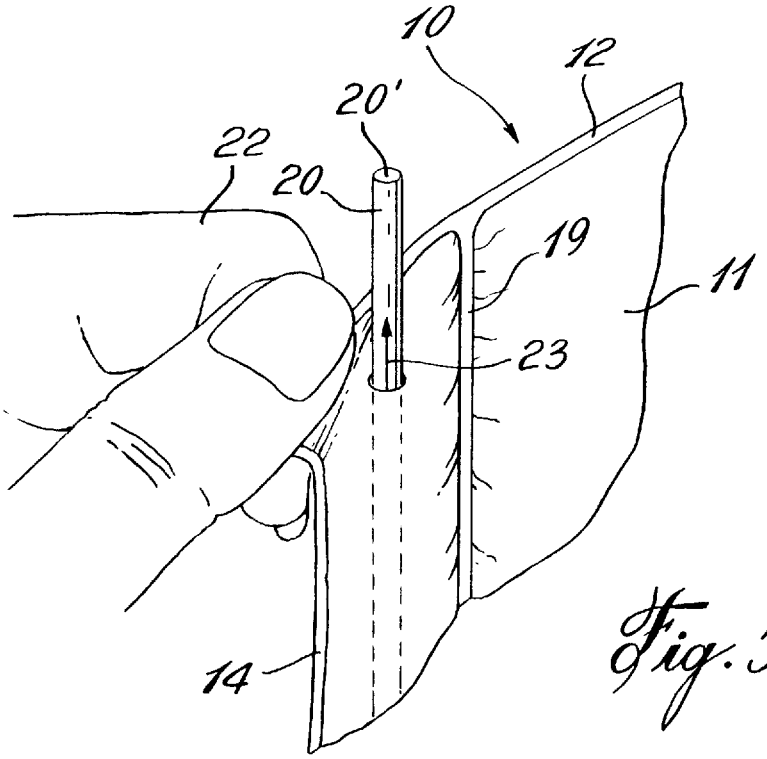
FIG. 5 is a perspective view partly fragmented, showing how the straw penetrates a side wall portion of the plastic film liquid pouch to extract the liquid product from the pouch.
Figure 6:
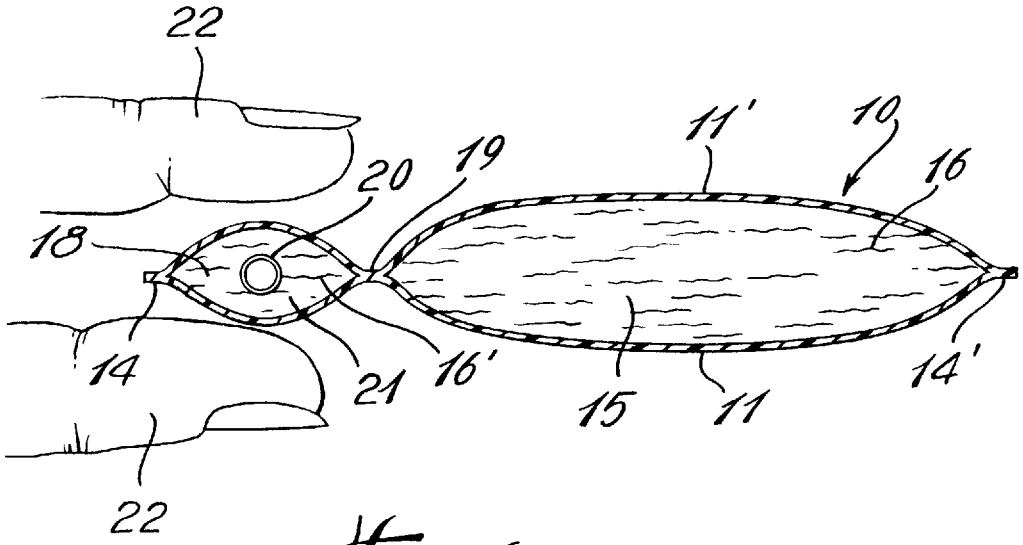
FIG. 6 is a section view of the liquid pouch showing the cross-sectional area of the straw restraining passage in relation to the main liquid product containing chamber.

Referring now additionally to FIGS. 2 to 7, and particularly FIG. 6, it can be seen that the internal straw restraining passage 18 defines a reduced cross-sectional area of the chamber, This reduced cross-sectional area is indicated by reference numeral 21 in FIG. 6 whereby the opposed sidewalls 11 and 11' of the bag 10 are close to one another and may be collapsed toward one another by the fingers, such as designated by reference numeral 22, of a user person and displacing a small quantity of liquid 16' in the straw restricted passage 18. Accordingly, a very limited amount of space 17 is required to accommodate this displaced liquid 16' while permitting the fingers 22 to grasp the straw and push a top end 20' of the straw upwardly in the direction of arrow 23, as shown in FIG. 5, whereby to puncture a top corner side wall portion of the bag whereby to expose the top end of the straw through the film sheet material to extract the liquid product 16 from the pouch 10. The product can be extracted by sipping it through the straw through the top end 20' of the straw 20 or by pressing onto the sidewalls 11 and 11' of the pouch or squeezing it to push the liquid through the straw 20. The film material is such as to provide a seal about the sidewall of the straw as it is pushed therethrough.

Figure 2:
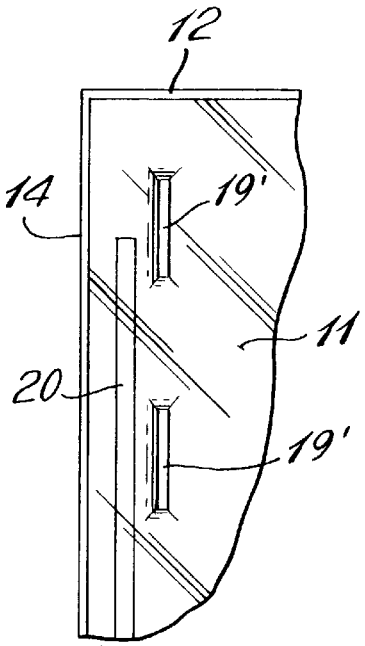
FIG. 2 is a fragmented plan view showing a modification of the construction of the internal straw restraining passage.
Figure 3:
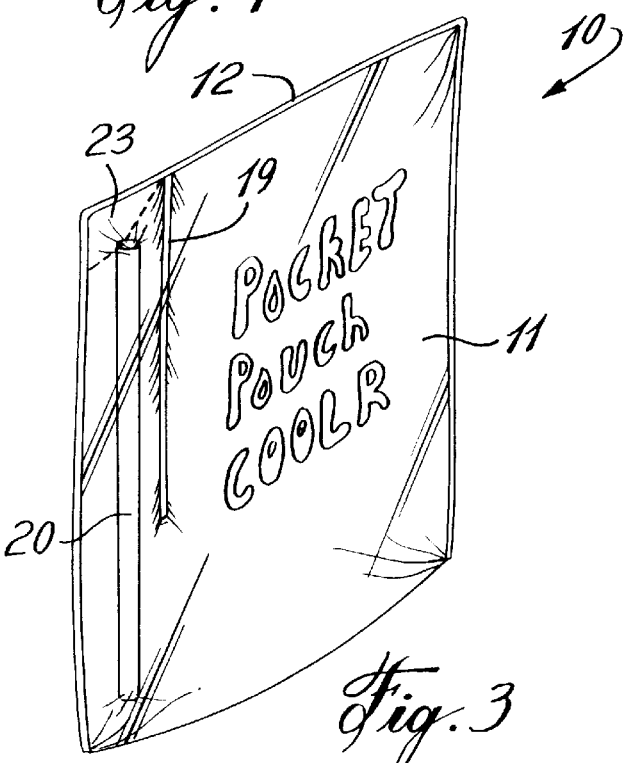
FIG. 3 is a perspective view of a plastic film liquid pouch constructed in accordance with the present invention.

As shown in FIG. 2 the internal straw restricting passage 18 may also be formed by short seal lines 19' which are spaced a predetermined distance from the sealed edge 14 and disposed substantially parallel thereto and in axial alignment with one another. These short spaced apart seal lines 19' may extend the full length of the bag, although not shown herein. A communicating passage is provided between the enclosed chamber 15 between the short seal lines 19' whereby to facilitate the extraction of the liquid product from the pouch through the bottom end 20" of the straw 20 after it is pushed through the bag. However, by applying pressure to the bag only a very limited communication passage is necessary between the straw restraining passage 18 and the main liquid product containing chamber 15 for liquid to be expulsed. Although in FIG. 1 the straight heat sealed line 19 is shown to extend to substantially mid length of the bag it can be formed much longer without affecting the operation of the liquid extraction process.

As shown in FIG. 4, in order to facilitate the use of the bag a fold tab 23 may be delineated on the front side wall 11 in a top corner of the pouch at the top end of the straw restraining passage to permit the user to fold the tab 23 rearwardly, as shown in FIG. 5, thereby exposing a corner sidewall portion which also has a delineated target 24 to indicate to the user that the straw free top end 20' should be positioned in that area and pushed through the side wall 11 of the bag, as shown in FIG. 5.

It can be appreciated that because the straw 20 is contained within a restrictive passage 18 that the straw is always at a predetermined position. This permits for the sidewalls of the pouch to be formed from opaque film material. It is only necessary to print on the sidewall of the pouch that the straw is disposed along an edge portion of the pouch. In any event, by feeling the edge of the pouch the straw is easily locatable to any user from young children to adult, thereby facilitating the locating and grasping of the straw and the puncturing of the bag by the straw. This important feature of the present invention greatly facilitates the use of such pouches and, eliminates accidental bursting of the pouch and permits the use of opaque film materials and further permits larger quantity of liquid products to be inserted into the bag as less free space is necessary to accommodate for the expansion of the liquid, if rendered in the frozen state. The straw restraining channel also greatly reduces the amount of liquid displaced when the pouch sidewalls are collapsed as was necessary with the prior art when the straw was free-floating in the pouch. This feature also permits the printing of more information on the sidewalls of the bag as it is not necessary to provide visual access to the straw located therein.

With reference now to FIGS. 8 to 11 there will be described one method of fabricating the plastic film liquid pouch of the present invention. As shown in FIG. 8, large quantities of straws 20 are contained within a hopper 30 which is vibrated to direct the straws into a discharge outlet 31 to thereafter enter into a feed channel 32 where they are displaced to a retrieving position 33 at a free-end of the feed channel 32. The end one 34, of the straws 20, is held at a grasping position by an arresting means 35. A pusher head 36 reloads a straw 20 from the hopper 30 every time an end one 34 of a straw 20 is retrieved by picker-jaws 37. The picker-jaws 37 are mounted on a displaceable carriage 38 which is free to move in a translation direction as indicated by arrow 39 and in a vertical direction as indicated by arrow 40. An airjet nozzel 41 is associated with the displaceable carriage 38.

Figure 9:
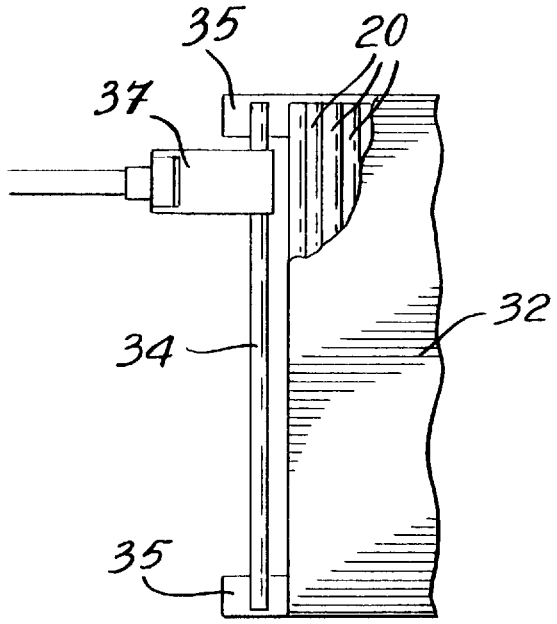
FIG. 9 is a simplified top fragmented view showing how a straw is grasped from the straw supply mechanism.

As shown in FIG. 9, the displaceable carriage 38 is moved in the translation direction whereby to place the picker-jaws 37 in line with the end one 34 of the straws 20 adjacent an end of this end straw 34. Picker-jaws then close and retract the end straw 34 from the feed channel 32. The displaceable carriage 38 then moves to a position, as shown in FIG. 10, with the straw 20 being aligned vertically above an open pouch, herein pouch 10' for discharge therein.

Figure 10:
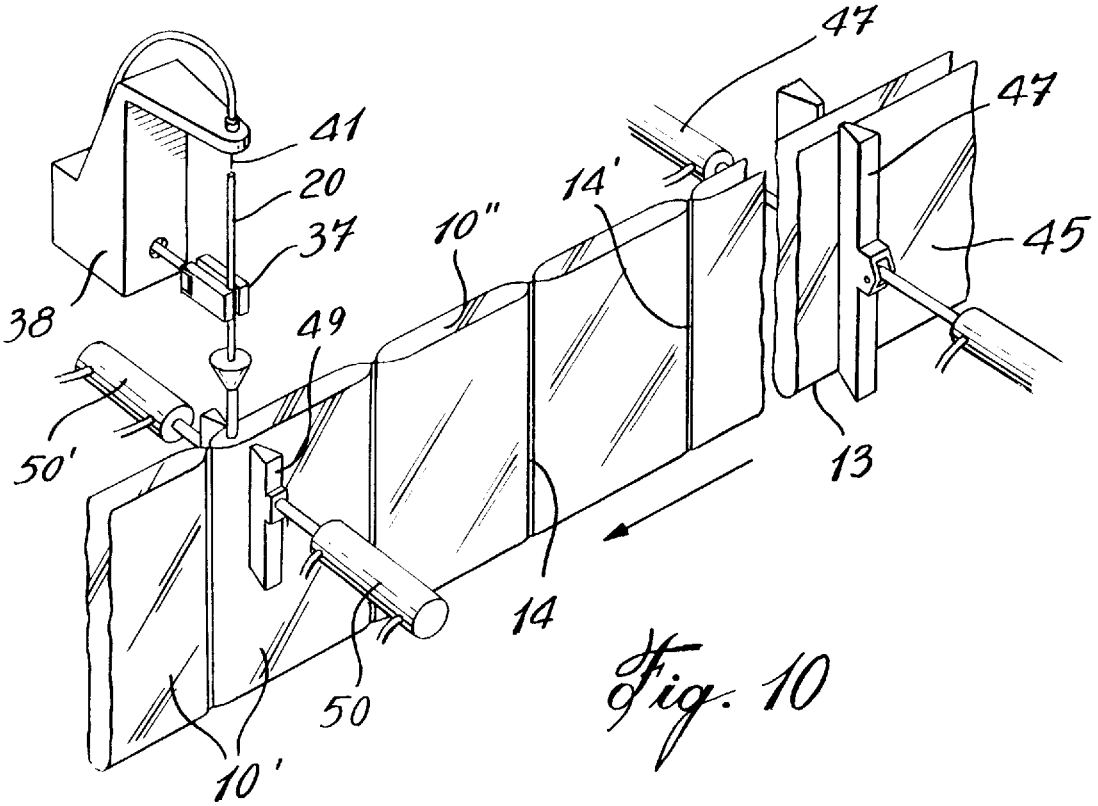
FIG. 10 is a simplified perspective view showing how the plastic film liquid pouches are formed as well as straw restraining passage.

Referring now to FIGS. 10 and, 11*a* to 11*d*, it can be seen that a film sheet 45 from a supply roll (not shown) is folded in half along a fold edge 46 which constitutes the bottom sealed edge 13 of the bag. This folded film sheet 45 is conveyed by support means, not shown, in juxaposition. Side edge seals or seams 14 and 14' are formed simultaneously by sealing bar 47 and 47' which are applied between the juxtaposed film sheets 45 at an indexing cycle of advancement of the film sheet whereby to form a plurality or series of open top end pouches 10'. Along the path of the opened top end pouches which are secured together by the side seals 14 and 14' there are various stations to form the straw restraining passage, to insert the straw within the pouch and to fill the pouch as well as sealing the top opened end thereof.

Figures 11A, 11B, 11C, 11D:
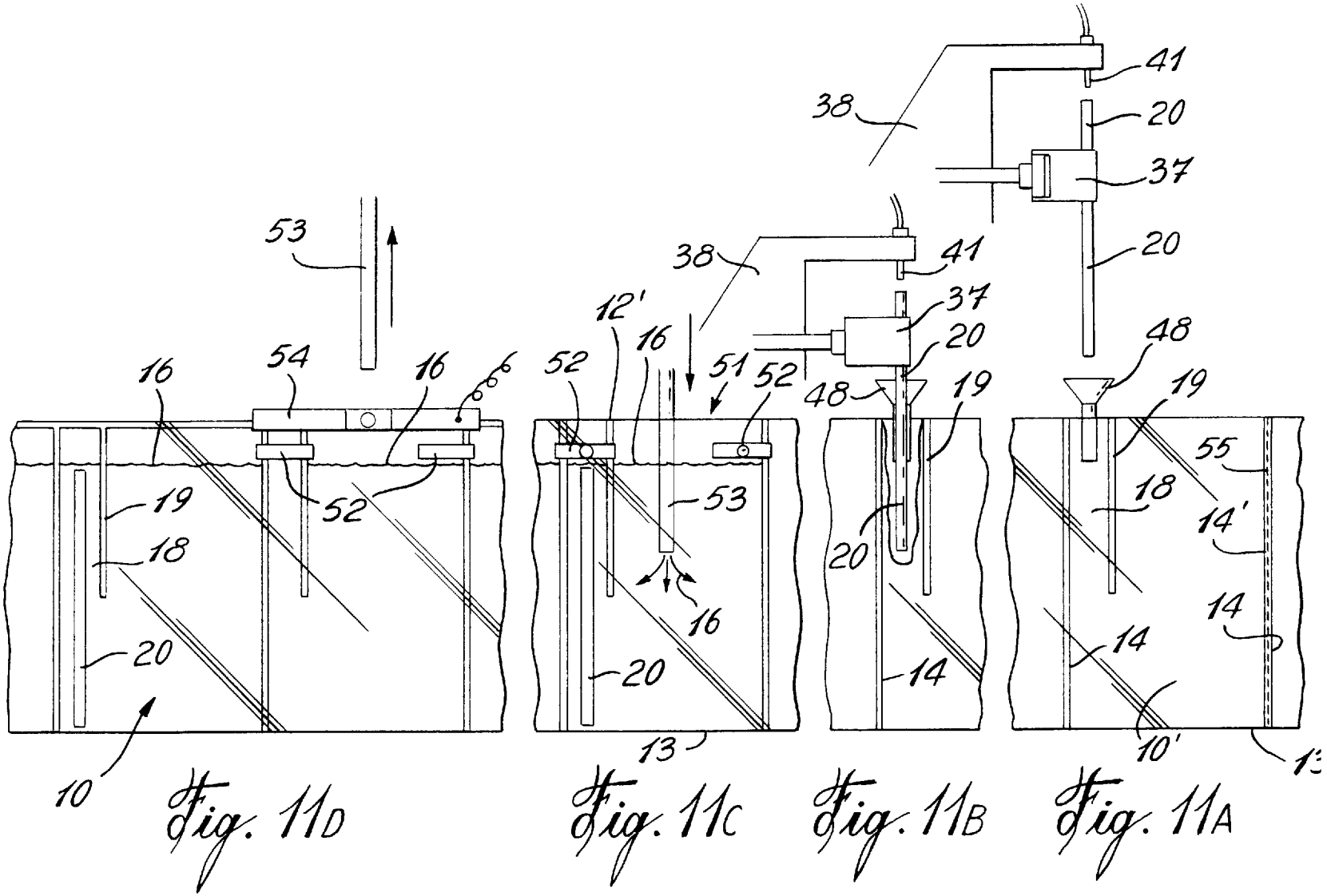
FIG. 11*a* to 11*d* are simplified side views showing how the plastic film liquid pouch of the present invention is formed with a straw positioned in the straw restraining passage and the liquid inserted therein, and the bag sealed.

These stations will now be described with preference to FIGS. 11*a* to 11*d*. As shown in FIG. 11*a* and 10, a straw inserting guide tube 48 is inserted in a top corner portion of the open end 10" of the bag and a straight heat seal line 19 is formed by the sealing head 49 of opposed seal pistons 50' shown in FIG. 10. The displaceable carriage 38 is then lowered, shown at FIG. 11*b*, to position the straw 20 within the guide tube 48 and the picker-jaws 37 are then opened with the airjet nozzel 41 ejecting air against the top end of the straw 20 shooting it in position into the straw restraining passage for it to be arrested by the bottom edge 13 of the bag 10'. It is pointed out that the straw may be inserted in the bag at the same time as the seal line 19 is formed so that as the sealing jaws 49 may be retracted simultaneously with the guide tube.

The bag with the straw therein then moves on to the filler station 51 where a pair of clamps 52 engage opposed top end portions of the bag and spaced from the upper top edge 12' of the bag and above the top end 20' of the straw 20. A filler tube 53 then enters the bag whereby to eject the liquid product 16 therein. At that station the filler tube 53 is retracted, although herein shown in FIG. 11 *d* for clarity, and sealing bars 54 are brought together whereby to seal the top edge 12 of the bag to form the seal top edge 12. The clamps 52 as well as the sealing bars 54 are then retracted and the filled bag 10 is advanced for separation from other filled bags 10. These filled bags 10 are separated by a perforated line 55 which is formed substantially centrally in the vertical sealed seams 14 and 14' as shown in FIG. 11*a* by the sealing bars.

Figure 12B:
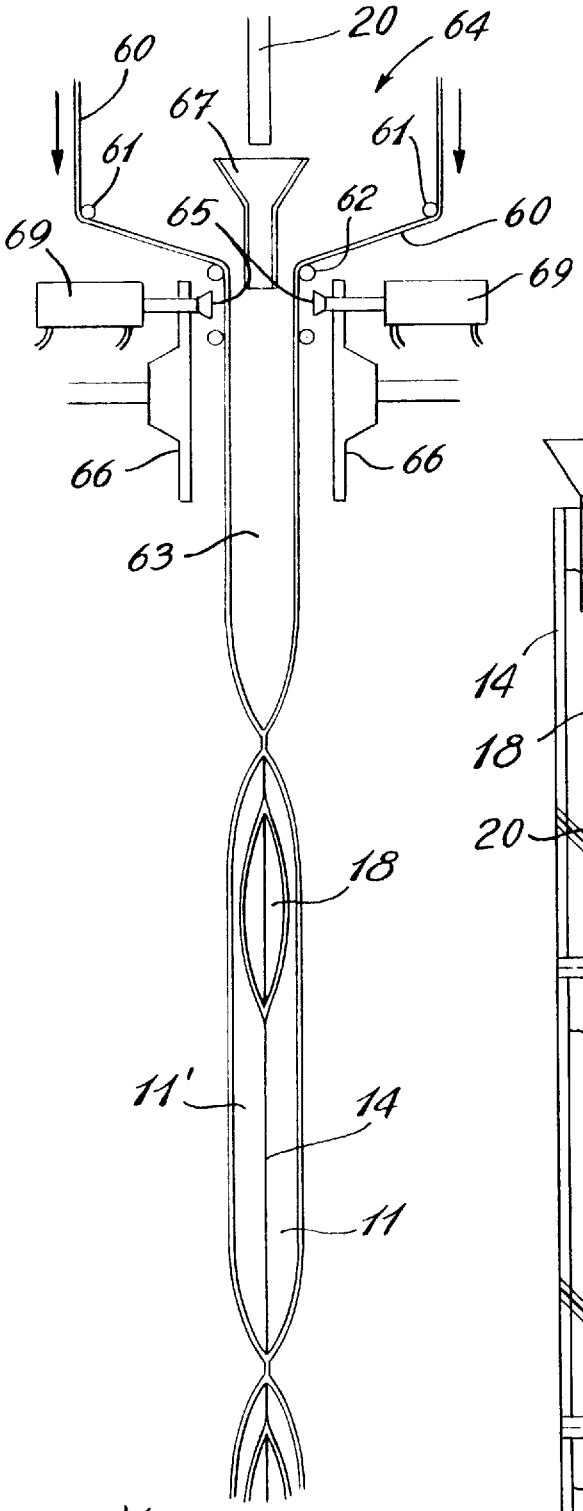
FIG. 12*b* is a side view of FIG. 12*a* showing the position of the sealing heads.
Figure 12A:
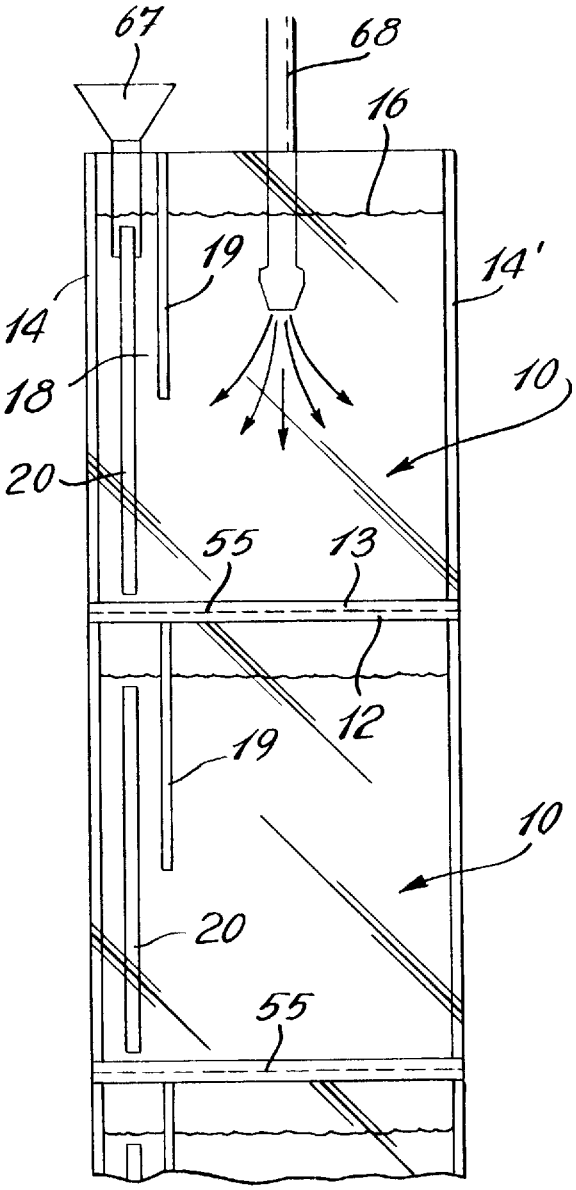
FIG. 12*a* is a plan view showing an alternative method of forming the plastic film liquid pouch of the present invention.

FIGS. 12*a* and 12*b* show a further method of manufacturing the plastic film liquid pouches of the present invention. As shown in FIGS. 12*a* and 12*b*, a pair of film sheets 60 and 60' are guided in a vertical plane by guide rolls 61 and 62 to form an open channel 63 at a filling station 64. The side seams or seal edges 14 and 14' as well as the bottom edge seal 13, is formed by seal bars, with only the bottom edge seal bar 65 being shown herein. Simultaneously the straight heat seal line 19 is formed by the sealing heads 66 and the straw 20 is inserted into the straw restraining passage 18 as previously described, by the use of a straw guide tube 67. Immediately thereafter the filler tube 68 moves into the open ended chamber 63 and ejects the liquid product 16 in the bag. The straw locating guide tube 67, as well as the filler tube 68, are retracted and the seal bars 69 are actuated to form the top seal. As the top seal is formed so is the bottom seal of the next bag to be formed and filled. The sealing heads 65 are also provided with means to form the serration 55, as previously described, whereby to separate the formed filled bags. The bags thus formed with liquid and a straw therein move downwardly to be separated at a discharge location of the bag forming machine.

Because the straw is located at a predetermined position on the edge of the pouch there is no need to manipulate the bag to search for the straw particularly if the liquid content is dark in color. It is much less complicated to provide instructions directly on the pouch so that young children can use the product. Because of the sanitary aspect of the pouch, it can be used to dispense fortified meal replacement beverages to the chronically ill in order not to transmit contagious bacterial infections. After use the pouch and straw can be disposed as any infected medical product, i.e., needles, syringes, gauze, etc. and it takes less place than a solid container. The product can also be frozen and used as an icepak with the straw always remaining sanitized inside the pouch.

It is within the ambit of the present invention to cover any obvious modifications of the preferred embodiment described herein, provided such modifications fall within the scope of the appended claims. As an example only, the straw restraining passage could be located in a central region of the pouch.

I claim:

1. A plastic film liquid pouch, said pouch comprising a pair of opposed side walls formed from impermeable film sheet material and having a sealed top edge, a sealed bottom edge, and opposed sealed side edges to form an enclosed chamber; a liquid product in said chamber, a space within said chamber to permit expansion of said liquid product, an internal straw restraining passage formed by seal means between said opposed side walls, said seal means being formed spaced a predetermined distance from one of said sealed side edges of said pouch whereby said straw restraining passage is immediately adjacent to one of said side edges, said straw restraining passage communicating with said liquid chamber, a straw held loosely captive in said straw restraining passage but axially displaceable therein; said straw restraining passage defining a reduced cross-sectional area of said chamber whereby said opposed side walls of said bag at said straw restraining passage when collapsed toward one another by the fingers of a user person to grasp said straw, will displace a restricted quantity of liquid in said chamber, a fold tab delineated on one of said side walls at a top end of said straw restraining passage to position a side wall corner portion of said one of said side walls over a top end of said straw held by the finger of a user person, whereby an upward pushing force on said straw by said user person will cause said top end of said straw to penetrate through said film sheet material to provide access to said straw to extract said liquid product from said pouch; said restricted quantity of liquid having a volume which is less than the volume of said space within said chamber.

2. A pouch as claimed in claim 1 wherein said seal means is comprised by a straight heat seal line formed between said opposed side walls and disposed substantially parallel to said one of said sealed side edges of said pouch, said heat seal line being shorter than said side edges.

3. A pouch as claimed in claim 2 wherein said straight heat seal line extends from said sealed top edge and terminates in a mid-length area of said pouch.

4. A pouch as claimed in claim 1 wherein said seal means is comprised of one or more short heat seal lines formed between opposed side walls and disposed substantially parallel to said one of said sealed side edges of said pouch, said seal lines being in substantially straight axial alignment.

5. A pouch as claimed in claim 1 wherein a puncture target is delineated on said side wall below said fold tab to position said end of said straw prior to pushing said end through said film sheet material.

6. A pouch as claimed in claim 1 wherein said film sheet material is a non-transparent material in at least a major portion of said pouch.

* * * * *